United States Patent [19]

Schwitzgöbel et al.

[11] 4,204,880

[45] May 27, 1980

[54] HIGH SPEED COOLING OF INGOTS

[75] Inventors: Rudolf Schwitzgöbel, Krefeld; Karl Monreal, Düsseldorf, both of Fed. Rep. of Germany

[73] Assignee: Mannesmann Aktiengesellschaft, Düsseldorf, Fed. Rep. of Germany

[21] Appl. No.: 872,935

[22] Filed: Jan. 27, 1978

[30] Foreign Application Priority Data

Jan. 28, 1977 [DE] Fed. Rep. of Germany ..... 2704127

[51] Int. Cl.[2] ..... C21D 1/62

[52] U.S. Cl. ..... 134/32; 72/201; 266/114

[58] Field of Search ..... 72/14, 201; 134/32, 134/49 R, 52 R, 57 R, 58 R, 64 R, 122 R; 266/44, 46, 96, 97, 114

[56] References Cited

U.S. PATENT DOCUMENTS 3,546,911 12/1970 Lenz ..... 266/117 X

OTHER PUBLICATIONS

Kobrin, C. L., "Plate Thrives on Severe Quench," *The Iron Age,* Sep. 8, 1966, pp. 64–67.

*Primary Examiner*—Paul A. Bell

*Attorney, Agent, or Firm*—Smyth, Pavitt, Siegemund, Jones & Pavitt

[57] ABSTRACT

Ingots to be cooled from above and below arrive on a reversible roller track and are moved back and forth for different lengths so that the ingot advances stepwise in the forward direction. Longer dwell times are interposed on each reversal.

5 Claims, 3 Drawing Figures

HIGH SPEED COOLING OF INGOTS

BACKGROUND OF THE INVENTION

The present invention relates to high speed cooling of slab ingots, round ingots or the like, which have been made, e.g. by continuous casting and are being moved on a roller track.

The casting (ingot) as emerging from a mold for continuous casting, must be cooled rather rapidly for a variety of reasons, to reduce the temperature thereof prior to further working. Spraying on water is a commonly practized method. Particularly, water is sprayed on from above or transversely to the direction of casting; see e.g. German printed patent applications No. 2,208,928 and No. 2,053,947. Cooling is not only needed immediately following the emergence of the only partially solidified ingot from the mold, but also after the ingot was cut into sections. The same is true with regard to ingots cast otherwise. It is also known to apply a coolant to a round ingot in a helical, overlapping flow pattern.

The known methods of cooling an ingot suffer certain drawbacks because of the specific operating condition any instant, certain portions, though narrow ones, are, so to speak, shielded from the coolant by the support rolls. This local difference in cooling was found to set up defects, possibly resulting even in transverse fractures in the interior of the ingot. On the face of it, the shielding effect of the withdrawal rolls seems to be inevitable.

DESCRIPTION OF THE INVENTION

It is an object of the present invention to provide a new and improved method and equipment for high speed but rather uniform cooling of ingots which are disposed on roller tracks.

In accordance with the preferred embodiment of the invention, it is suggested to move the ingot through a zone of spray cooling on a back and forth basis, but for unequal distances; preferably the forward motion prevails slightly to advance the ingot in relatively small steps while preferably a period of rest is interspaced between each reversal. Such dwell periods are now permissible, because they are relatively short in relation to total cooling time, and the ingot will rest in different positions in each of these rest or dwell periods, so that overall cooling becomes quite uniform. One will preferably control the periods of forward motion, reverse motion, and dwell times by appropriate timers.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
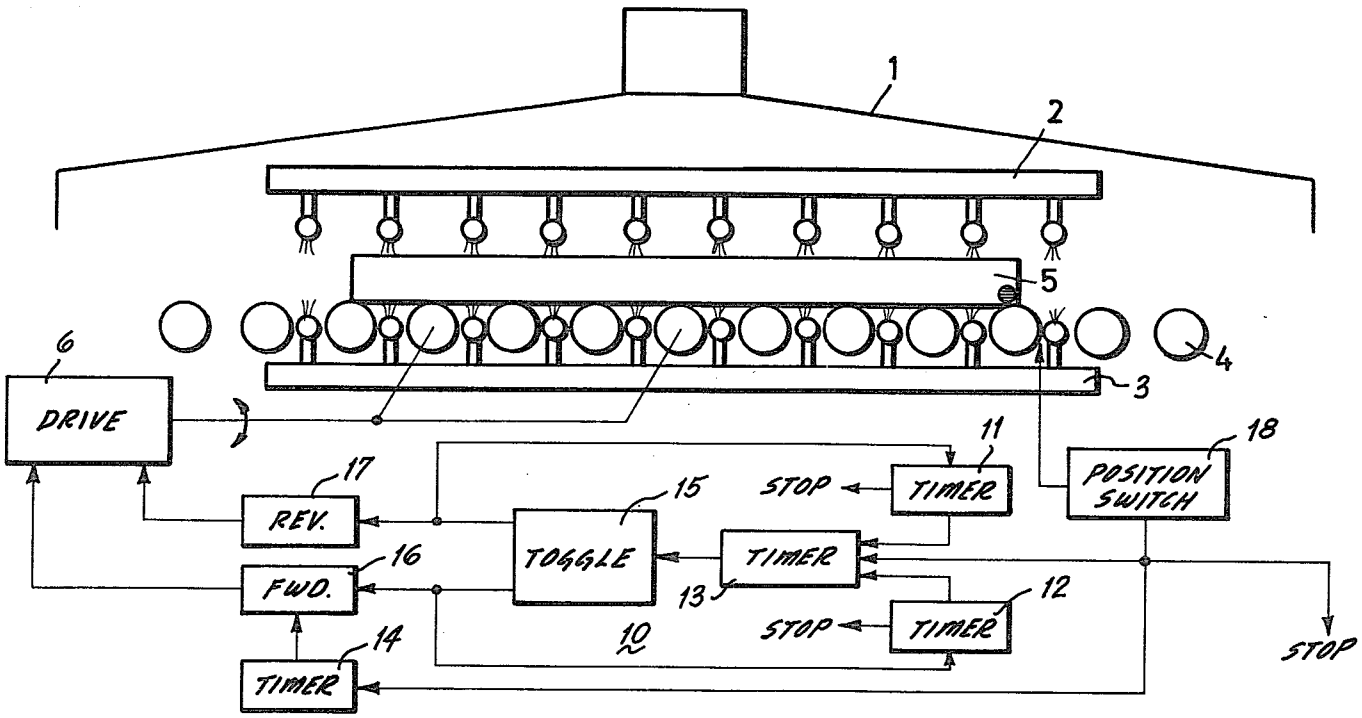
FIG. 1 is a schematic side view of a cooling station in accordance with the preferred embodiment.

Proceeding now to the detailed description of the drawings, the figures show a cooling hood 1 below which is provided a "cooling comb" 2 with downwardly directed spray nozzles. A similar comb 3, but with upwardly directed spray nozzles, is disposed below comb 2, defining a cooling space or cooling zone between. An ingot 5 is moved into, through and out of this cooling space by means of a roller track 4.

Track 4 is controlled by means of a reversable drive 6 via a transmission or the like. Not all rolls of the track need to be driven. The reversable drive 6 is under control of a circuit 10 which issues timed forward and reverse signals, and may also issue brake control (stop) signals to ensure stopping of the drive in fairly precise instants and positions as far as the roller track and, ultimately, the ingot 5 is concerned.

The control circuit 10 includes four timers (or the equivalent software in a processor) 11, 12, 13 and 14, respectively, for timing relatively short periods for reversal (11); slightly larger periods for advance (12); comparatively long periods of a waiting or dwell time (13); and for timing the overall cooling period (14).

The timer 13 which meters the dwell or stop time when run triggers a toggle device 15, such as a flip-flop with a single input command signal only when changing state to turn on alternatingly a forward control 16 or a reverse control 17 for the drive 6. The timers 11 and 12 are triggered respectively by reverse and forward commands and they, in turn, trigger the dwell time timer 13, and issue stop signals. A position switch 18 responds to an initial arrival of an ingot such as 5 in the cooling zone and triggers the dwell time timer 13. Alternatively, it may trigger the reverse control 17 and the reverse motion timer 11. In addition, switch 18 triggers timer 14 for metering the overall cooling period. Timer 14, in turn, provides an override forward command. Through logic gating, the execution of that command may be deferred until, e.g. a current reverse drive period or a current dwell time period has expired.

The device operates as follows. Following the movement of the ingot 5 under the hood 1, position switch 18 will respond to the passage of the rear end of the ingot, stop the drive 6 and trigger the dwell time timer 13 for metering a period of rest during which the ingot remains in the position depicted in FIG. 1. In addition, switch 18 triggers the timer 14 because the cooling period begins. By way of example, timer 13 may run for 25 seconds and timer 14 for 5 minutes.

Figure 2:
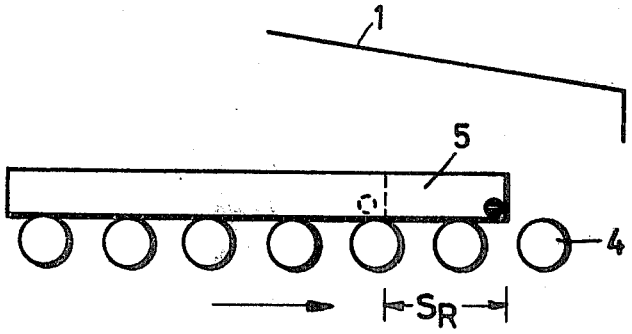
FIGS. 2 and 3 are views of a portion of the station during different phases of the operation.

After the timer 13 has run, it triggers toggle or gates 15 to issue a reverse command and control 17 will cause drive 6 to start up but in the reverse direction. Toggle 15 may normally be set to be in a state following issuance of a forward command. The reverse command triggers also the reverse motion timer 11. Now, roller track 4 moves the ingot from the position as per FIG. 1 towards the position shown in FIG. 2. The timer 11 may run for 0.4 seconds, whereupon it issues a stop command and triggers also the timer 13. The ingot remains in the position as per FIG. 2 for 25 seconds. It can readily be seen that the ingot is supported on points being different from those supporting it as per FIG. 1. For ease of illustration, a black dot has been placed on ingot 5 and one can readily track the position of that dot on the roller track 4 in the several figures.

After timer 13 has run again, it controls the drive for forward motion and triggers the timer 12. The ingot is thus moved from the position as per FIG. 2 towards the position as per FIG. 3. Timer 12 runs for a period which is larger than the period of timer 11. By way of example, timer 12 runs for 0.65 seconds, whereupon it issues a stop command and triggers dwell time timer 13. This new stop position is somewhat further in the advance direction than the position as per FIG. 1, because timer 12 has a longer period than timer 11. Thus, following one complete reverse/advance cycle, the ingot has moved by a small step in the advance direction.

Figure 3:
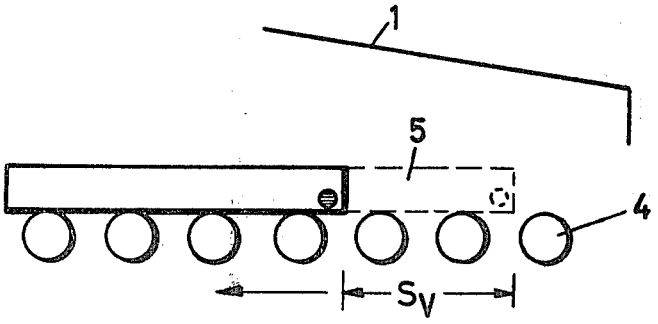

The ingot stays again in the position of FIG. 3 for 25 seconds which, as far as support and shielded surface areas is concerned, is still different from the previous positions of the ingot on the track. After timer 13 has run, the drive is started again in the reverse mode and roller track 4 runs again for 0.4 seconds in the reverse.

This back and forth movement with a residual forward component following each reverse/forward cycle, moves the ingot stepwise towards the left. After the timer 14 has run, the back and forth control is overriden and the roller track continues in or is switched to the advance mode to take the ingot out of the cooling zone. A typical time here is about 5 minutes.

The ingot is, therefore, rather uniformly cooled. The dwell time can readily be shortened (or extended) if desirable or even necessary (or permissible) so that the shielding effect of the rolls is reduced to a level in which any lateral temperature differential is no longer noticeable. The overall length of the cooling station is quite limited and shorter than a station in which the ingot to be cooled is kept moving continuously.

The prime object is to attain a plurality of different cooling positions for the ingot throughout the period of cooling. These different positions could also be established by a single timer for motion, and under conditions in which the drive is moved faster in the forward than in the reverse direction, but that is not the preferred mode of practicing the invention. In addition, the forward and reverse cycles may not necessarily be established by reversing the drive. The drive may run at constant speed in one direction and the forward and reverse commands may be executed by a reversable clutch and transmission as interposed between the drive and the track.

The invention is not limited to the embodiments described above but all changes and modifications thereof not constituting departures from the spirit and scope of the invention are intended to be included.

We claim:

1. In a method of high speed cooling an ingot on a roller track, there being spray nozzles disposed to spray coolant towards the ingot, the improvement of moving the ingot on and by means of the roller track, alternatingly back and forth while being sprayed with the coolant, whereby during phases of motion in one direction, the ingot traverses a path longer than a path it traverses when moved in the opposite direction, so that the ingot engages rolls of the roller track in different positions on each reversal and the ingot progresses stepwise in the one direction.

2. In a method as in claim 1, wherein the travel path in the forward direction is larger than the travel path traversed by the ingot in the succeeding or preceeding reverse movement, so that the ingot is stepwise advanced in the forward direction.

3. In a method as in claim 1, wherein in-between each reverse and forward phases the ingot dwells in a stationary position.

4. In a method as in claim 3, wherein the forward phase travel path is about 50% longer than the reverse phase travel path.

5. In a method as in claim 1 or 4, wherein the dwell phase lasts considerably longer than each of the reverse and forward phases.

* * * * *